US007810951B1

(12) United States Patent
Lee et al.

(10) Patent No.: US 7,810,951 B1
(45) Date of Patent: Oct. 12, 2010

(54) LED MODULE HAVING HEAT DISSIPATION STRUCTURE AND OPTIMAL LIGHT DISTRIBUTION

(75) Inventors: Tsu Lee, Taipei (TW); Feng Ma, Mi Yang District (CN); Jin-Yun Yang, Jiujiang (CN); Zhong-Lin Tang, Shao Yang District (CN); Lei Zhao, Yue Yang (CN)

(73) Assignee: Pan-Jit International Inc., Kaohsiung Hsien (TW)

( * ) Notice: Subject to any disclaimer, the term of this patent is extended or adjusted under 35 U.S.C. 154(b) by 0 days.

(21) Appl. No.: 12/512,360

(22) Filed: Jul. 30, 2009

(30) Foreign Application Priority Data

Jun. 17, 2009 (TW) ..... 98120192 A

(51) Int. Cl.
*F21V 33/00* (2006.01)

(52) U.S. Cl. ..... 362/249.03; 362/249.02; 362/800; 362/218; 362/269; 362/294

(58) Field of Classification Search ..... 362/249.02, 362/249.03, 311.02
See application file for complete search history.

(56) References Cited

U.S. PATENT DOCUMENTS 6,561,690 B2 * 5/2003 Balestriero et al. ..... 362/555
2009/0154159 A1 * 6/2009 Graybill et al. ..... 362/249.02
2009/0185373 A1 * 7/2009 Grajcar ..... 362/249.02

* cited by examiner

*Primary Examiner*—Laura Tso
(74) *Attorney, Agent, or Firm*—Apex Juris, pllc; Tracy M Heims

(57) ABSTRACT

An LED module comprises a heat dissipating bracket, a substrate, multiple LED assemblies and two rotatable mounting assemblies. The heat dissipating bracket has a top panel, a bottom panel and multiple flues. Each flue connects a corresponding top hole of the top panel and a bottom hole of the bottom panel. The substrate is mounted on the bottom panel and has multiple independent through holes respectively corresponding to the flues. The LED assemblies are respectively mounted on the substrate between two adjacent through holes. The rotatable mounting assemblies are respectively connected to two ends of the heat dissipating bracket, wherein the heat dissipating bracket is adapted to change an illuminating direction of the LED assemblies by rotating with the rotatable mounting assemblies. With the heat dissipating bracket and the rotatable mounting assemblies, the LED module obtains good heat-dissipating efficiency and optimal light distribution.

9 Claims, 11 Drawing Sheets

LED MODULE HAVING HEAT DISSIPATION STRUCTURE AND OPTIMAL LIGHT DISTRIBUTION

BACKGROUND OF THE INVENTION

1. Field of the Invention

The present invention relates to an LED module, especially to an LED module having a heat dissipation structure and optimal light distribution.

2. Description of the Related Art

Because of risk of energy shortage and improved public awareness, governments and environmental organizations are making efforts to promote energy conservation through improved light sources. Current solutions include low-energy, fluorescent bulbs, but these are bulky and contain mercury so causing possible health problems if broken or when incorrectly disposed of.

Therefore, light emitting diodes (hereafter LED) are small and efficient. Furthermore developing LED technology is constantly enhancing illumination of LEDs and reducing production costs so LEDs are beginning to replace other light sources.

However, an LED module for use in an LED lamp usually provides a small and uneven illuminating area since each LED emits highly directional light. If the LED module is disposed on a ceiling, a light gradient decreases from a center to a periphery more obviously than a fluorescent light.

Besides, the LED module requires many simultaneously illuminated LEDs that generate heat. Conventionally, the heat is dissipated by multiple metallic fins mounted on the LED module to increase a surface area of the LED module and improve heat conduction. However, use for extended periods increases air temperature around the fins and lowers a heat dissipating efficiency of the LED module.

To overcome the shortcomings, the present invention provides an LED module having a heat dissipation structure and optimal light distribution in order to mitigate or obviate the aforementioned problems.

SUMMARY OF THE INVENTION

The main objective of the present invention is to provide an LED module having a heat dissipation structure and optimal light distribution.

The LED module comprises a heat dissipating bracket, a substrate, multiple LED assemblies and two rotatable mounting assemblies. The heat dissipating bracket has a top panel, a bottom panel and multiple flues. Each flue connects a corresponding top hole of the top panel and a bottom hole of the bottom panel. The substrate is mounted on the bottom panel and has multiple independent through holes respectively corresponding to the flues. The LED assemblies are respectively mounted on the substrate between two adjacent through holes. The rotatable mounting assemblies are respectively connected to two ends of the heat dissipating bracket, wherein the heat dissipating bracket is adapted to change an illuminating direction of the LED assemblies by rotating with the rotatable mounting assemblies. With the heat dissipating bracket and the rotatable mounting assemblies, the LED module obtains good heat-dissipating efficiency and optimal light distribution.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
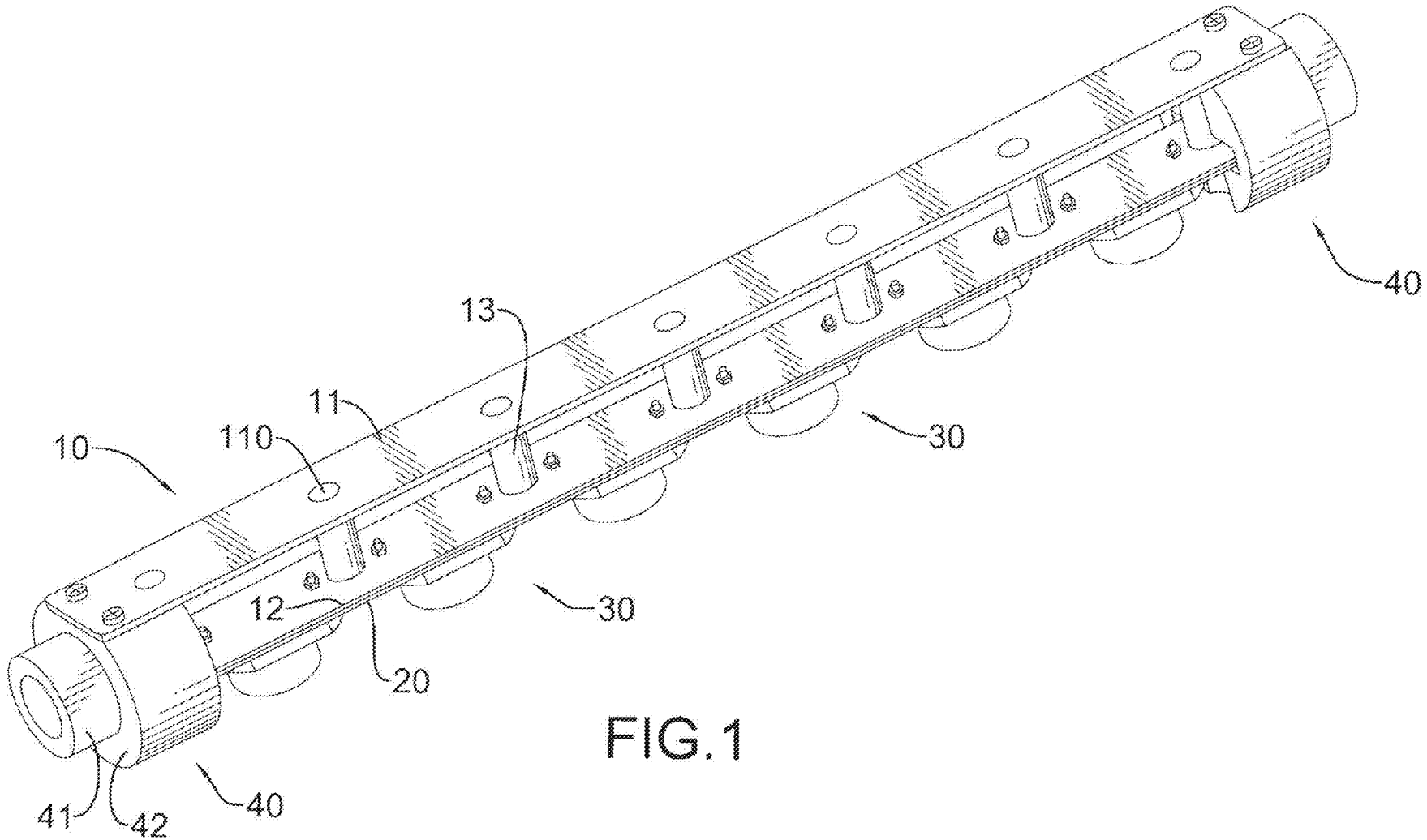
FIG. 1 is a perspective view of a first embodiment of an LED module in accordance with the present invention.

With reference to FIG. 1, an LED module in accordance with the present invention comprises a heat dissipating bracket (10), a substrate (20), multiple LED assemblies (30) and two rotatable mounting assemblies (40).

Figure 2:
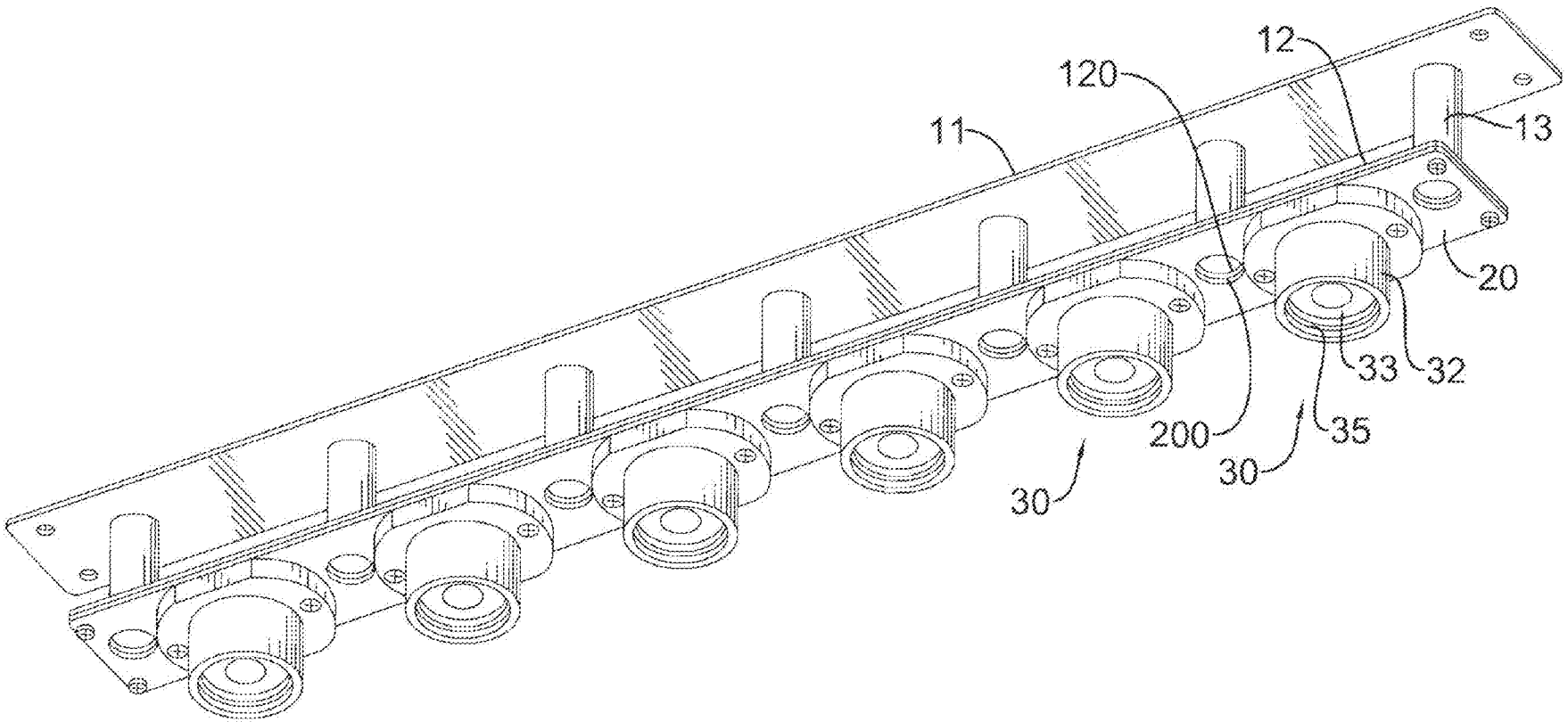
FIG. 2 is another perspective view of the LED module in FIG. 1, shown without rotatable mounting assemblies.

With further reference to FIG. 2, the heat dissipating bracket (10) has two opposite ends, a top panel (11), a bottom panel (12) and multiple flues (13). The top panel has multiple independent top holes (110) formed through the top panel (11). The bottom panel (12) has a front surface and multiple independent bottom holes (120) formed through the bottom panel (12) respectively corresponding to the top holes (110). The flues (13) are mounted between the top and the bottom panels (11, 12) and connect corresponding top and bottom holes (110, 120).

The substrate (20) is mounted on the front surface of the bottom panel (12) and has multiple independent through holes (200). The through holes (200) of the substrate (20) are formed through the substrate (20) and correspond to the flues (13). The substrate (20) may have multiple metal wires forming a circuit and may be bound to the front surface of the bottom panel (12) with heat conductive adhesive.

Figure 3:
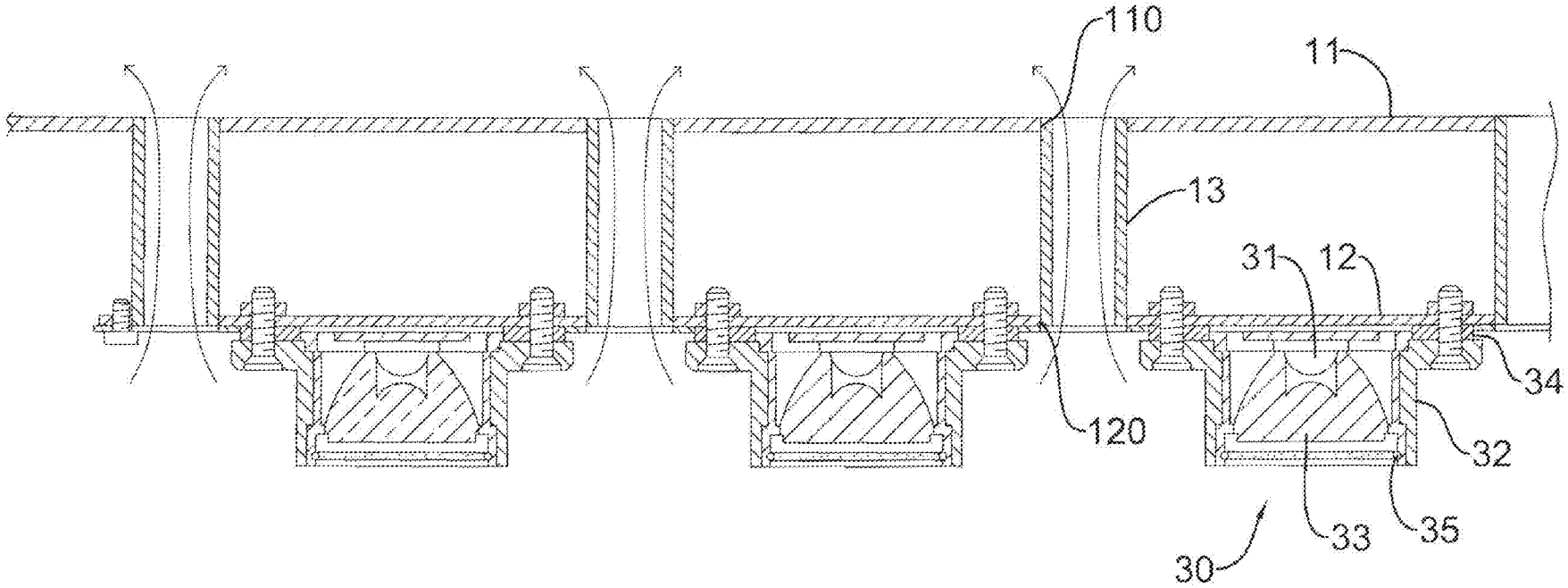
FIG. 3 is an operational cross sectional view of the LED module in FIG. 2.

With further reference to FIG. 3, each LED assembly (30) is mounted on the substrate (10) between two adjacent through holes (200). In a first embodiment of the present invention, the LED assembly (30) comprises an LED unit (31), a sleeve (32), a lens unit (33), a first waterproof washer (34) and a second waterproof washer (35). The LED unit (31) may be soldered on the substrate (10) by surface mount technology. The sleeve (32) is mounted around the LED unit (31). The lens unit (33) is received in the sleeve (32) and mounted on the LED unit (31). The first waterproof washer (34) is disposed between the sleeve (32) and the substrate (10). The second waterproof washer (35) is disposed between the lens unit (33) and the sleeve (32). The LED assemblies (30) are waterproofed by the first and the second waterproof washers (34, 35). When the LED units (31) are alight and air around the bottom panel (12) is heated so the temperature at the bottom holes (120) of the bottom panel (12) will be higher than at the top holes (110) of the top panel (11) and air density at the bottom holes (120) of the bottom panel (12) will be lowered. Since the flues (13) connect the bottom holes (120) and top holes (110), air currents are formed to move air through the flues (13) from the bottom holes (120) to the top holes (110). Such directional convection will reach a thermal equilibrium at a lower temperature when compared to non-directional convection of conventional LED modules. Therefore heat-dissipating efficiency is enhanced.

The rotatable mounting assemblies (40) are respectively connected to the ends of the heat dissipating bracket (10), wherein the heat dissipating bracket (10) is adapted to change an illuminating direction of the LED assemblies (30) by rotating with the rotatable mounting assemblies (40). Each has a fixed member (41) and a rotating member (42). The fixed member (41) is adapted to be mounted on a mount of a casing of an LED lamp. The rotating member (42) is rotatably attached with the fixed member (41) and connected to a corresponding end of the heat dissipating bracket (10), wherein the heat dissipating bracket (10) rotates relative to the fixed member (41) via the rotating member (42). In a first embodiment of the rotatable mounting assembly (40), the fixed member (41) and the rotating member (42) are cylinders. The fixed member (41) is coaxial with the rotating member (42), protrudes from a surface of the rotating member (42) and has a diameter smaller than a diameter of the rotating member (42).

Figure 6:
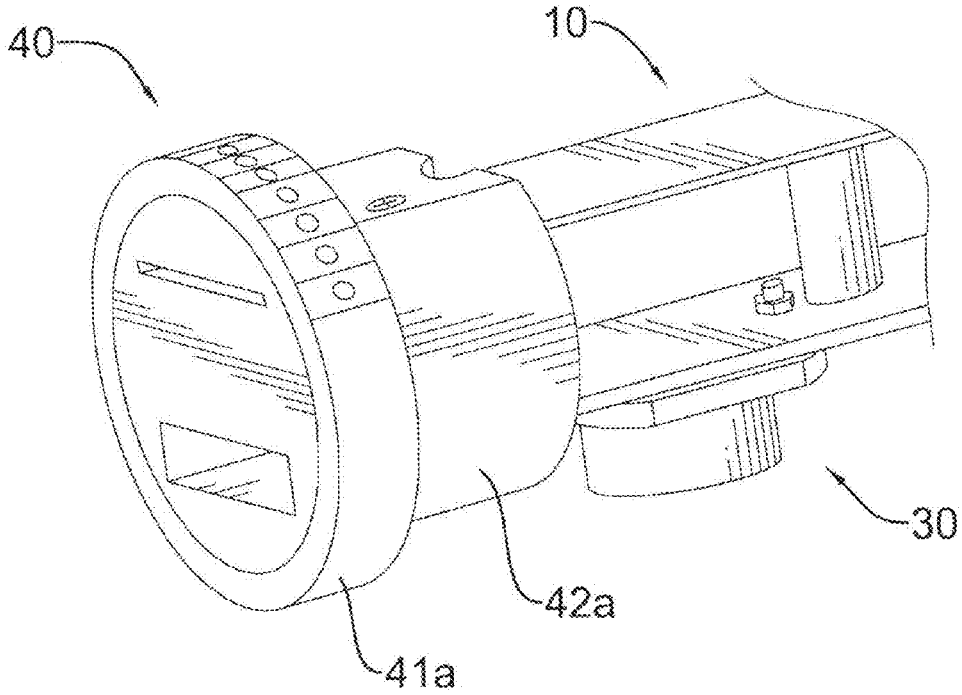
FIG. 6 is an enlarged partial perspective view of the LED module showing a-second embodiment of the rotatable mounting assembly.

With further reference to FIG. 6, in a second embodiment of the rotatable mounting assembly (40), the fixed member (41*a*) is ring-shaped and mounted around the rotating member (42*a*).

Figure 7:
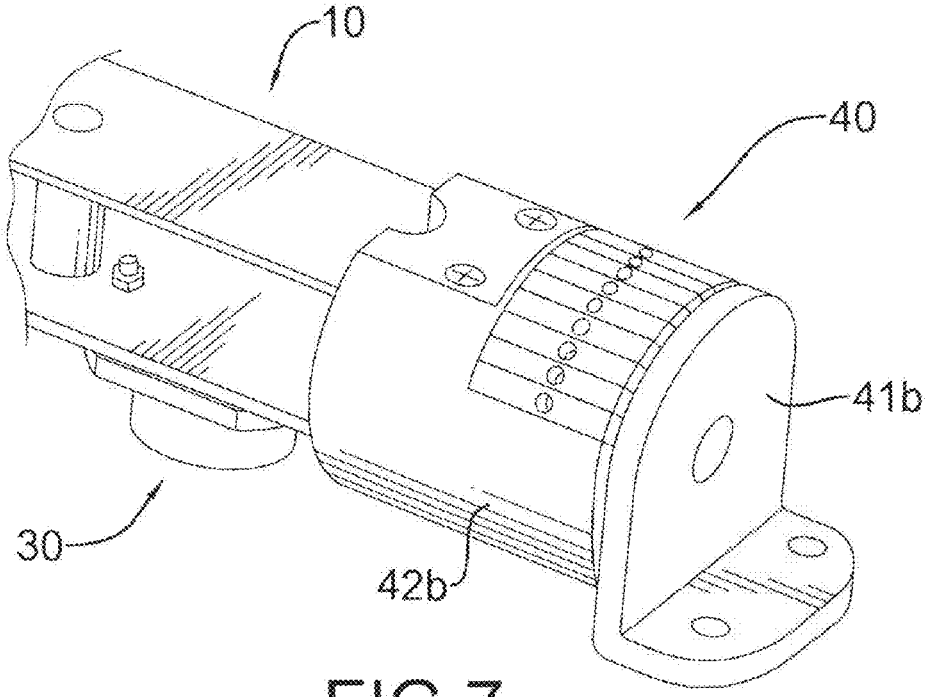
FIG. 7 is an enlarged partial perspective view of the LED module showing a third embodiment of the rotatable mounting assembly.

With further reference to FIG. 7, in a third embodiment of the rotatable mounting assembly (40), the fixed member (41*b*) is L-shaped and has a body and a mounting tab. The body is to be attached with the rotating member (42*b*). The mounting tab is formed on and protrudes transversely from the body and is to be mounted on a mount of a housing of an LED lamp.

Figure 8:
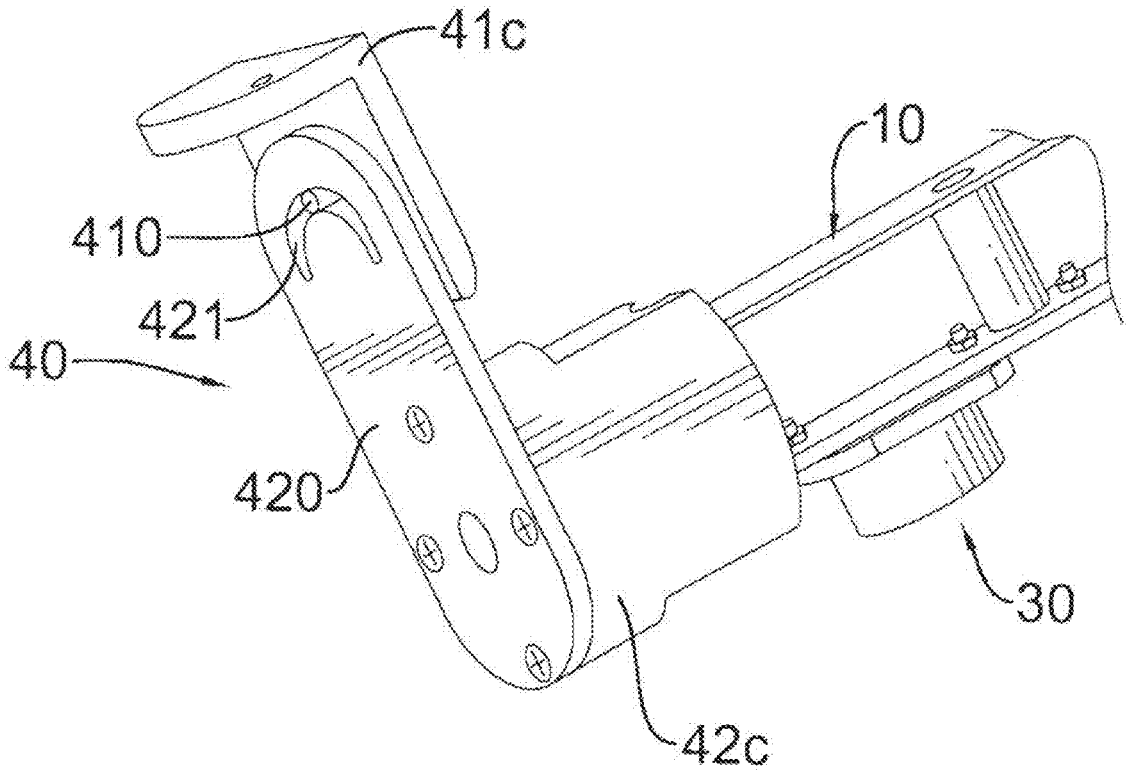
FIG. 8 is an enlarged partial perspective view of the LED module showing a fourth embodiment of the rotatable mounting assembly thereof.

With further reference to FIG. 8, the rotating member (42*c*) has an end and an adjusting panel (420). The adjusting panel (420) is mounted on the end of the rotating member (42*c*) and has a curved slot (421). The fixed member (41*c*) has a surface and a protrusion (410). The protrusion (410) is formed on and protrudes from the surface of the fixed member (41*c*) and mounted slidably in the curved slot (421) of the adjusting panel (420).

Figure 4:
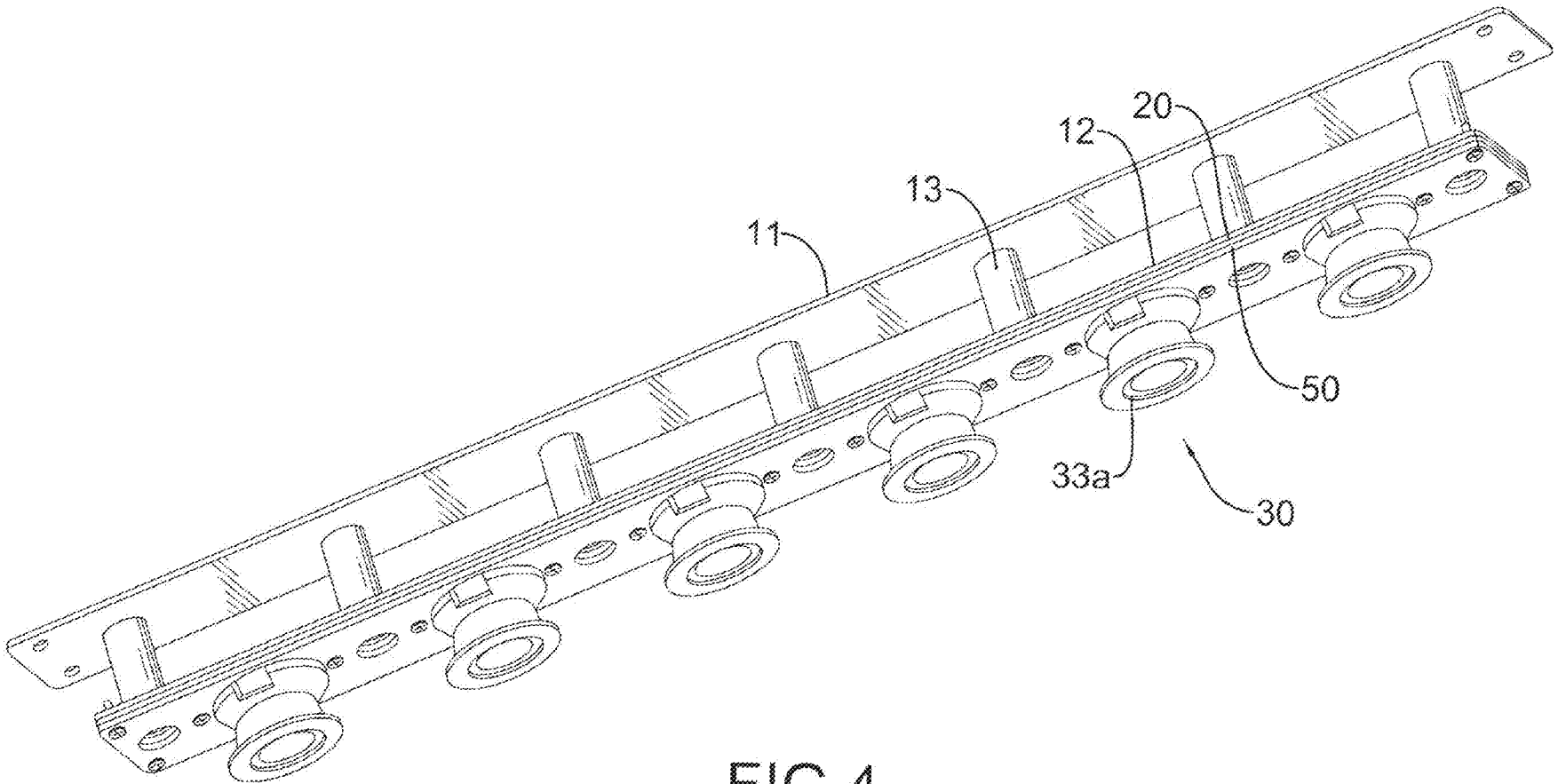
FIG. 4 is a perspective view of a second embodiment of the LED module in accordance with the present invention, shown without rotatable mounting assemblies.
Figure 5:
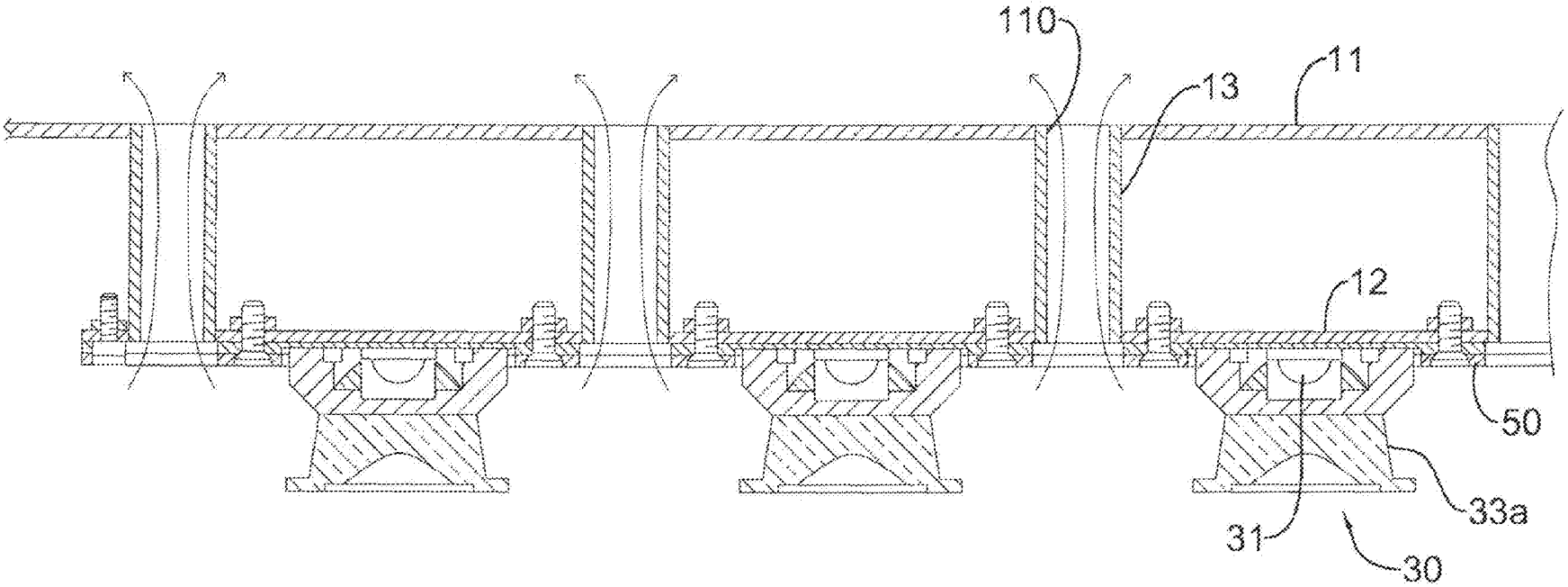
FIG. 5 is a cross sectional view of the LED module in FIG. 4.

With further reference to FIGS. 4 and 5, in a second embodiment of the LED module, the LED module further comprises a cover (50) mounted on the substrate (20) and each LED assembly (30) has an LED unit (31) and a lens (33*a*). The LED unit (3.1) is soldered on the substrate (20) through the cover (50). The lens unit (33*a*) is mounted on the LED unit (31) and has a bottom. The bottom of the lens unit (33*a*) may be connected to the substrate (20) and the cover (50) using epoxy resin.

Figure 9:
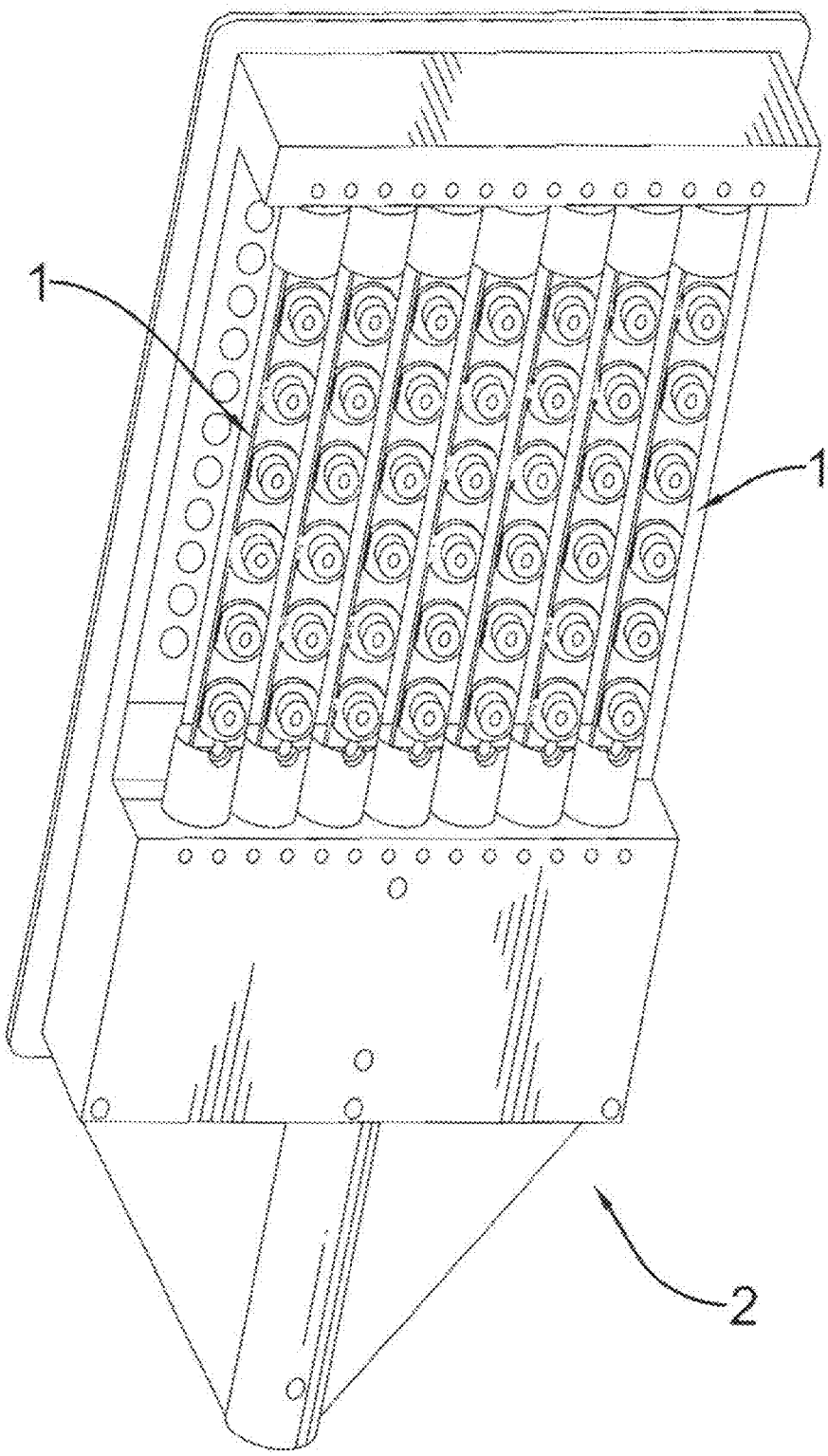
FIG. 9 is a perspective view of a first embodiment of an LED lamp having multiple LED module of the present invention.

With reference to FIG. 9, when applied to an LED lamp, multiple LED modules (1) of the present invention are arranged on an emission side of a casing (2) of the LED lamp side by side. Each LED module (1) is attached with the casing (2) by fixing the fixed members (41) of the rotatable assemblies (40) to corresponding mounts of the casing (2). Since the rotating members (42) are rotatably attached with the fixed members (41), the heat dissipating bracket (10) can rotate relative to the fixed members (41) to change an illuminating direction of the LED assemblies (30). As long as each LED module (1) is adjusted in appropriate illuminating directions, the LED lamp can provide a wider illuminating range and an even illumination.

Figure 10:
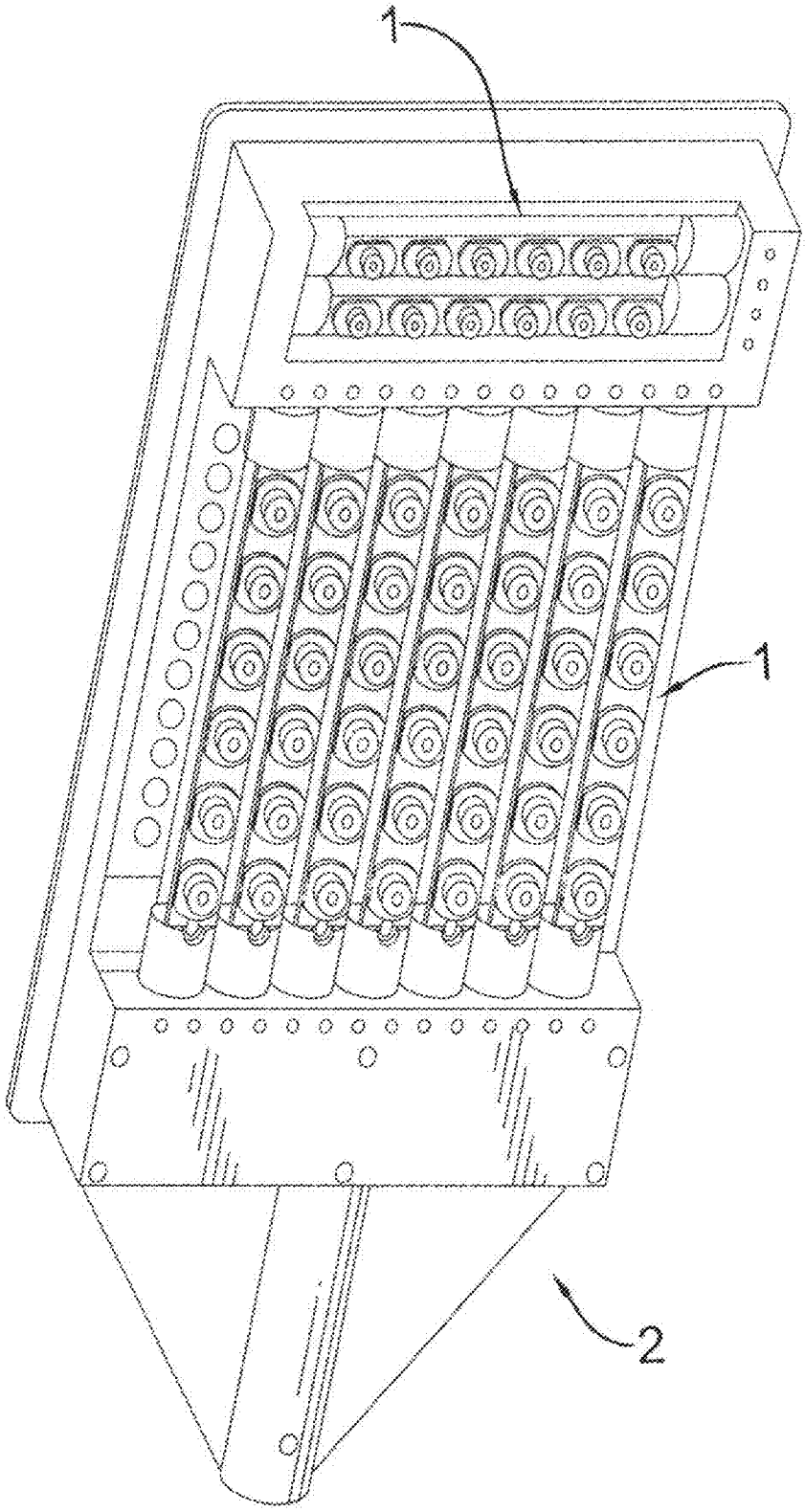
FIG. 10 is a perspective view of a second embodiment of an LED lamp having multiple LED module of the present invention.

Besides, the LED modules (1) are not limited to be arranged side by side, any arrangement is possible to meet a design requirement. With further reference to FIG. 10, a group of LED modules (1) may be disposed perpendicular to another group of LED modules (1).

Figure 11:
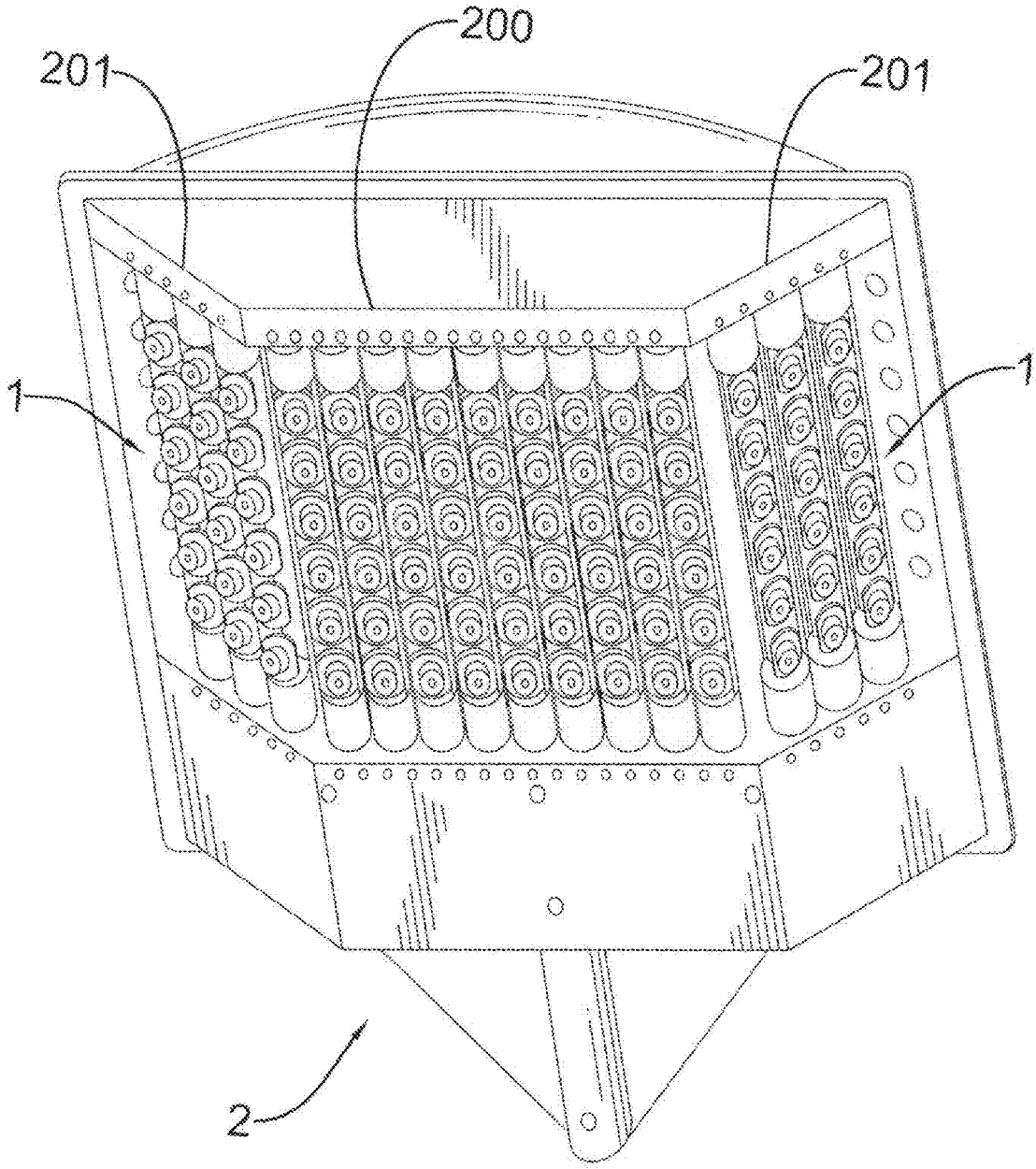
FIG. 11 is a perspective view of a third embodiment of an LED lamp having multiple LED module of the present invention.

With further reference to FIG. 11, the casing (2) of the LED lamp may provide a central plane (200) and two side planes (201) for arranging multiple LED modules (1), wherein the side planes (201) are extended obliquely from two opposite sides of the central plane (200). Furthermore, the lens unit (33) has a diffractor that evenly diverges a point light source of an LED. Hence each of the LED assemblies (30) provides a uniform light source having a particular illuminating range. To meet a required light distribution, the LED modules (1) with different illuminating directions may cooperate with different lens unit (33) providing diffraction, refraction or dispersion.

Figure 12:
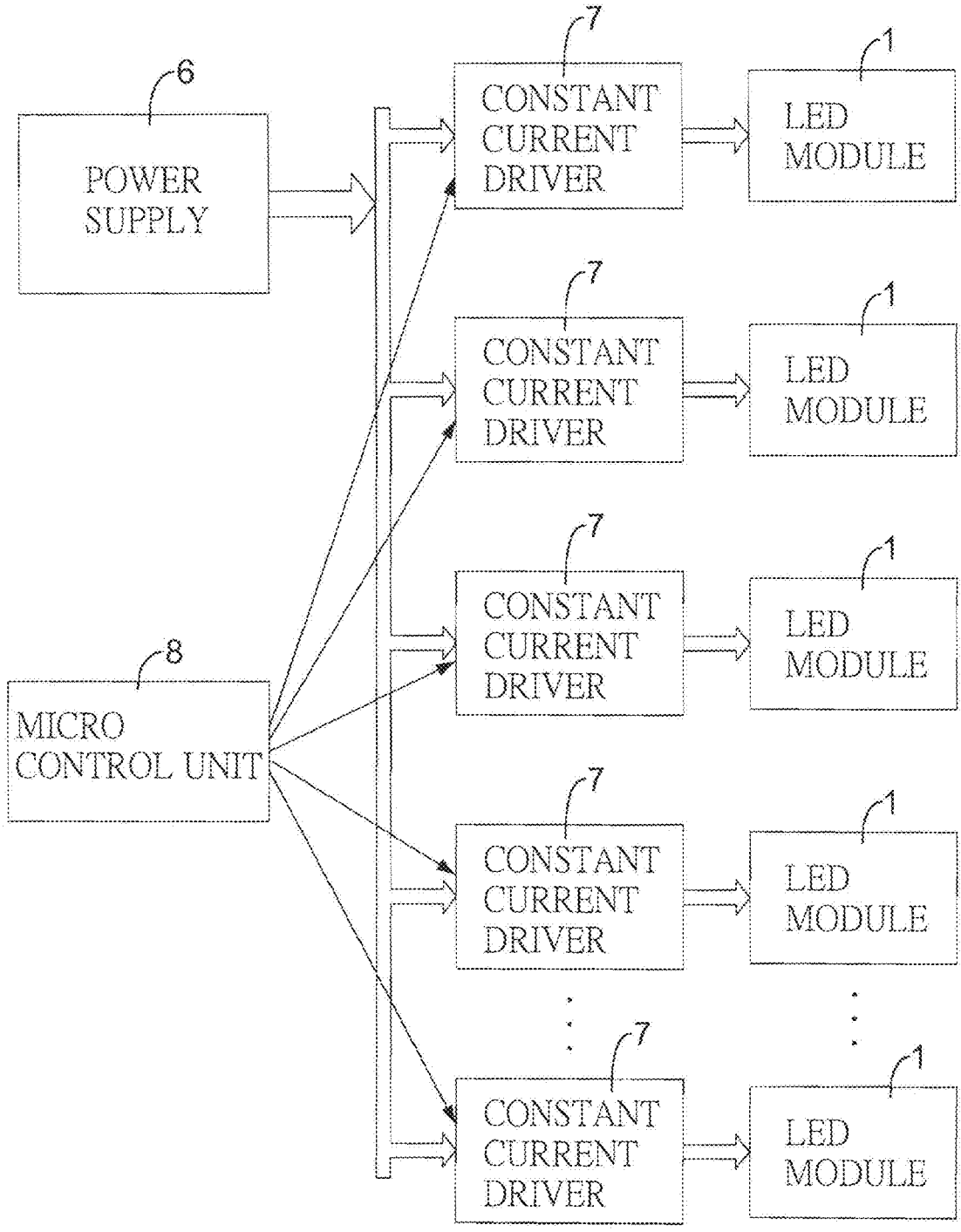
FIG. 12 is a block diagram of a lighting control system for the LED modules of the present invention.

With further reference to FIG. 12, the present invention may be practiced in a lighting control system. The lighting control system may comprise multiple LED modules (1), a power supply (6), multiple constant current drivers (7) and a micro control unit (8). The power supply (6) may be an AC/DC adapter that converts AC utility power to DC power or may be a solar cell system that provides DC power. Each constant current driver (7) is connected to an LED module (1), has a PWM (pulse width modulation) capability and may be a nonlinear buck DC-DC converter having a PWM brightness control pin. The micro control unit (8) is connected to the constant current drivers (7) to set an operation current for each LED module (1) via the constant current drivers (7). The micro control unit (8) first sets a duty cycle of a square waveform signal and sends the square waveform signal to the PWM brightness control pins of the constant current drivers (7) to set the operation current of each LED module (1). For example, when a maximum operation current value is set at 700 mA by voltage division, the constant current driver (7) can output a maximum operation current of 700 mA when a high voltage level signal of 5 volts is supplied to the PWM brightness control pin. When the PWM brightness control pin receives a square waveform signal of a duty cycle of 90%, the constant current drivers (7) then adjusts the operation current to 630 mA. When the PWM brightness control pin received a square waveform signal of a duty cycle of 80%, the constant current drivers (7) then adjusts the operation current to 560 mA; 70% to 490 mA, and so on. Therefore, by setting the square waveform signal of different duty cycle and supplying the signal to the PWM brightness control pin of each constant current driver (7), the micro control unit (8) can accurately and efficiently set the operation current of, each LED module (1) to suitable values. Thereby the illumination distribution can be adjusted as required.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An LED module comprising:

a heat dissipating bracket having two opposite ends;

a top panel having multiple independent top holes formed through the top panel;

a bottom panel having a front surface and multiple independent bottom holes formed through the bottom panel and respectively corresponding in position to the top holes; and multiple flues mounted between the top and the bottom panels and each flue connected to a corresponding top hole and a corresponding bottom hole;

a substrate mounted on the front surface of the bottom panel and having multiple independent through holes formed through the substrate and corresponding to the flues;

multiple LED assemblies respectively mounted on the substrate between two adjacent through holes; and two rotatable mounting assemblies respectively connected to the ends of the heat dissipating bracket, wherein the heat dissipating bracket is adapted to change an illuminating direction of the LED assemblies by rotating with the rotatable mounting assemblies.

2. The LED module as claimed in claim 1, wherein each rotatable mounting assembly has a fixed member; and a rotating member rotatably attached with the fixed member and connected to a corresponding end of the heat dissipating bracket, wherein the heat dissipating bracket rotates relative to the fixed member via the rotating member.

3. The LED module as claimed in claim 2, wherein the rotating member and the fixed member are cylinders; and the fixed member is coaxial with the rotating member, protrudes from a surface of rotating member and has a diameter smaller than a diameter of the rotating member.

4. The LED module as claimed in claim 2, wherein the fixed member is ring-shaped and mounted around the rotating member.

5. The LED module as claimed in claim 2, wherein the fixed member is L-shaped and has a body; and a mounting tab formed on and protruding transversely from the body; and the rotating member is mounted rotatably on the body of the fixed member.

6. The LED module as claimed in claim 2, wherein the rotating member has an end; and an adjusting panel mounted on the end of the rotating member and having a curved slot; and the fixed member has a surface and a protrusion formed on and protruding from the surface of the fixed member and mounted slidably in the curved slot of the adjusting panel.

7. The LED module as claimed in claim 1, wherein each LED assembly has an LED unit soldered on the substrate;

a sleeve mounted around the LED unit; and a lens unit received in the sleeve and mounted on the LED unit.

8. The LED module as claimed in claim 7, wherein each LED assembly further has a first waterproof washer disposed between the sleeve and the substrate; and a second waterproof washer disposed between the lens unit and the sleeve.

9. The LED module as claimed in claim 1 further has a cover mounted on the substrate, wherein each LED assembly has an LED unit soldered on the substrate through the cover; and a lens unit mounted on the LED unit and has a bottom connected to the substrate and the cover.

* * * * *